US006874988B2

(12) United States Patent
Tiemann

(10) Patent No.: US 6,874,988 B2
(45) Date of Patent: Apr. 5, 2005

(54) GAS TURBINE BLADE

(75) Inventor: Peter Tiemann, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 35 days.

(21) Appl. No.: 10/381,485

(22) PCT Filed: Sep. 18, 2001

(86) PCT No.: PCT/EP01/10789

§ 371 (c)(1),
(2), (4) Date: Mar. 26, 2003

(87) PCT Pub. No.: WO02/27146

PCT Pub. Date: Apr. 4, 2002

(65) Prior Publication Data

US 2004/0022630 A1 Feb. 5, 2004

(30) Foreign Application Priority Data

Sep. 26, 2000 (EP) ..... 00120926

(51) Int. Cl.[7] ..... F04D 29/38
(52) U.S. Cl. ..... 415/115; 416/97 R; 416/96 A
(58) Field of Search ..... 416/97 R, 95, 416/96 A, 96 R; 415/115, 116

(56) References Cited

U.S. PATENT DOCUMENTS

| | | | | |
|---|---|---|---|---|
| 2,847,185 A | | 8/1958 | Petrie et al. | 415/115 |
| 3,540,810 A | | 11/1970 | Kercher | 416/90 R |
| 3,715,170 A | | 2/1973 | Savage et al. | 416/97 R |
| 3,799,696 A | | 3/1974 | Redman | 416/97 R |
| 4,616,976 A | | 10/1986 | Lings et al. | 416/97 R |
| 5,120,192 A | * | 6/1992 | Ohtomo et al. | 415/115 |
| 5,288,207 A | | 2/1994 | Linask | 416/97 R |
| 5,468,125 A | | 11/1995 | Okpara et al. | 416/97 R |
| 5,609,466 A | | 3/1997 | North et al. | 415/115 |

* cited by examiner

*Primary Examiner*—F. Daniel Lopez
*Assistant Examiner*—Dwayne J. White
(74) *Attorney, Agent, or Firm*—Harness, Dickey & Pierce, P.L.C.

(57) ABSTRACT

A gas turbine blade includes a combined convective cooling effected by a meandering cooling channel and an impact cooling channel and an impact cooling effected via an impact cooling insert. The impact cooling insert is arranged inside a first partial section of the meandering cooling channel extending along the front edge of the blade pan. The impact cooling insert tapers along this first partial section.

20 Claims, 1 Drawing Sheet

GAS TURBINE BLADE

This application is the national phase under 35 U.S.C. § 371 of PCT International Application No. PCT/EP01/10789 which has an International filing date of Sep. 18, 2001, which designated the United States of America and which claims priority on European Patent Application number EP 00120926.1 filed Sep. 26, 2000, the entire contents of which are hereby incorporated herein by reference.

FIELD OF THE INVENTION

The invention generally relates to a gas turbine blade. In one embodiment, it relates to one having an airfoil leading edge and an airfoil trailing edge and having an inner cooling structure, comprising a meandering cooling passage with sections directed along the blade axis for directing a cooling fluid from the airfoil leading edge to the airfoil trailing edge.

BACKGROUND OF THE INVENTION

A hollow gas turbine blade which can be cooled by cooling air is disclosed in U.S. Pat. No. 5,468,125. The cooling air is blown into cooling chambers, running parallel to the blade axis, of the hollow gas turbine blade. There, passing through the chambers, it cools the hot surface of the gas turbine blade from the inside. The incoming cooling air not yet heated is first of all directed past the leading edge of the gas turbine blade, this leading edge being subjected to especially high temperatures and therefore having to be cooled in an especially efficient manner. After the cooling air has been passed through the blade in such a way as to also cool the other regions of the blade, it leaves the latter at the trailing edge of the blade via holes.

SUMMARY OF THE INVENTION

An object of an embodiment of the invention is to specify a gas turbine blade which utilizes a cooling fluid in an especially efficient manner for cooling the gas turbine blade.

According to an embodiment of the invention, this object may be achieved by specifying a gas turbine blade directed along a blade axis and having an airfoil leading edge and an airfoil trailing edge and having an inner cooling structure, comprising a meandering cooling passage with sections directed along the blade axis for directing a cooling fluid from the airfoil leading edge to the airfoil trailing edge, a first section of the sections running along the airfoil leading edge and having an inlet region for the cooling fluid and an outlet region for the cooling fluid. The first section has an impingement-cooling insert which, with its insert front side directed toward the airfoil leading edge, runs parallel to the airfoil leading edge, the impingement-cooling insert tapering toward the outlet region.

In this case, an embodiment of the invention is based on the insight that, with conventional internal cooling of a gas turbine blade by a meandering cooling passage, the airfoil leading edge cannot always be cooled in a sufficiently efficient manner, since a comparatively small surface on the inside of the airfoil leading edge faces the outside, subjected to especially high thermal loading, of the airfoil leading edge. Purely convective cooling by use of a cooling-fluid flow in the meander-passage section at the airfoil leading edge may possibly be insufficient in order to sufficiently reduce the temperature of the airfoil leading edge.

On the other hand, an embodiment of the invention is based on the observation that, although cooling solely by an impingement-cooling insert makes possible greater heat dissipation precisely at the airfoil leading edge due to the greater cooling capacity of the impingement cooling, cooling of the airfoil overall by the impingement-cooling insert is comparatively inefficient, since the cooling fluid absorbs less heat overall. For example, in a gas turbine blade cooled by cooling air and having meander cooling, the cooling fluid discharging from the trailing edge after passing through the meander passage is warmer than the cooling fluid likewise discharging from a blade trailing edge after impingement cooling.

An embodiment of the invention now combines, for the first time, impingement cooling with meander-passage cooling in such a way that the advantages of these two methods are utilized without at the same time being exposed to the disadvantages of the respective methods to the same extent. This is achieved by the airfoil leading edge being cooled with high cooling capacity by the impingement-cooling insert, which, however, is only inserted in the first section of the meandering cooling passage. In this case, the impingement-cooling insert extends parallel to the airfoil leading edge, so that the entire airfoil leading edge is cooled by impingement cooling. At the same time, however, the impingement-cooling insert tapers from the inlet region of the first section right up to the outlet region of the first section.

In the first section, therefore, the type of cooling in the direction of flow of the cooling fluid flowing in the first section changes from impingement cooling to convective cooling by way of the cooling fluid flowing in the first section. The rest of the blade is then cooled convectively by the cooling fluid flowing through the further sections. In this way, the cooling fluid, with regard to its cooling capacity, is utilized to the greatest possible extent, but without at the same time having to dispense with the especially effective impingement cooling in the region of the airfoil leading edge. Further cooling measures may of course be provided for the gas turbine blade, e.g. film cooling by cooling fluid discharging from the airfoil outer wall.

a) The impingement-cooling insert preferably covers the entire inflow region. In this way, all the cooling fluid is first of all directed into the impingement-cooling insert.

b) The impingement-cooling insert, in its cross-sectional area, preferably tapers in proportion to a cooling-fluid quantity discharging on the impingement-cooling insert in a measured manner along the blade axis. The tapering of the impingement-cooling insert, i.e. the reduction in its cross-sectional area in a direction parallel to the blade axis, may be effected in different ways, depending on requirements. However, tapering in proportion cooling-air quantity discharging from the impingement-cooling insert along the blade axis has the advantage in particular that the airfoil leading edge overall is uniformly supplied with impingement-cooling air. This means especially homogeneous cooling.

c) The impingement-cooling insert is preferably surrounded by air-guide ribs which are directed transversely to the blade axis and which direct cooling fluid, discharging from the impingement-cooling insert, around the impingement-cooling insert in the direction of the airfoil trailing edge. The cooling fluid, after it has struck the airfoil wall in an impingement-cooling manner, is thus directed by such air-guide ribs away from the airfoil leading edge along the outer wall of the impingement-cooling insert and then enters the free part of the first section. The free part of the first section is that part in which the impingement-cooling insert is not arranged. The air-guide ribs are also preferably directed relative to a plane oriented perpendicularly to the blade axis in such a way that they additionally direct the cooling fluid in a direction from the inlet region to the outlet region. The cooling fluid entering the free part of the first section therefore already has a flow component in the direction of the main flow in this first section. The flow guidance by means of the air-guide ribs therefore permits as much of a vortex-free flow as possible, which is thus especially favorable with regard to a pressure loss, of the cooling fluid through the gas turbine blade.

d) The gas turbine blade is preferably designed as a guide blade which is formed with an inner ring. When the guide blade is used in a gas turbine, the inner ring serves to seal off a hot-gas duct of the gas turbine relative to a rotor of the gas turbine. An inner-ring cooling passage leads from the impingement-cooling insert to the inner ring. Whereas, in the case of conventional cooling of the gas turbine blade solely by convective cooling of a cooling fluid flowing in a meander passage, the efficiency of the cooling of an inner ring of a gas turbine blade is reduced by virtue of the fact that the cooling fluid fed to the inner ring is already inevitably heated by a flow past the airfoil leading edge, the feeding of cooling fluid from the impingement-cooling insert to the inner ring has the advantage of being able to feed unheated cooling fluid to the inner ring. Due to the higher cooling capacity of the unheated cooling fluid, the consumption of cooling fluid for the cooling of the inner ring is lower as a result. However, this advantage of the feeding of cooling fluid from an impingement-cooling insert, due to the special design of the tapering impingement-cooling insert, does not now lead to the above-described disadvantage of a conventional impingement-cooling insert, which actually leads to a comparatively high consumption of cooling fluid due to poor utilization of the cooling capacity of the cooling fluid during the cooling of the airfoil.

The embodiments described under a) to d) can also be combined with one another in any desired manner.

BRIEF DESCRIPTION OF THE DRAWINGS

The invention is explained in more detail by way of example with reference to the drawing. The single FIGURE shows a gas turbine guide blade in a longitudinal section.

DETAILED DESCRIPTION OF THE PREFERRED EMBODIMENTS

Figure 1:
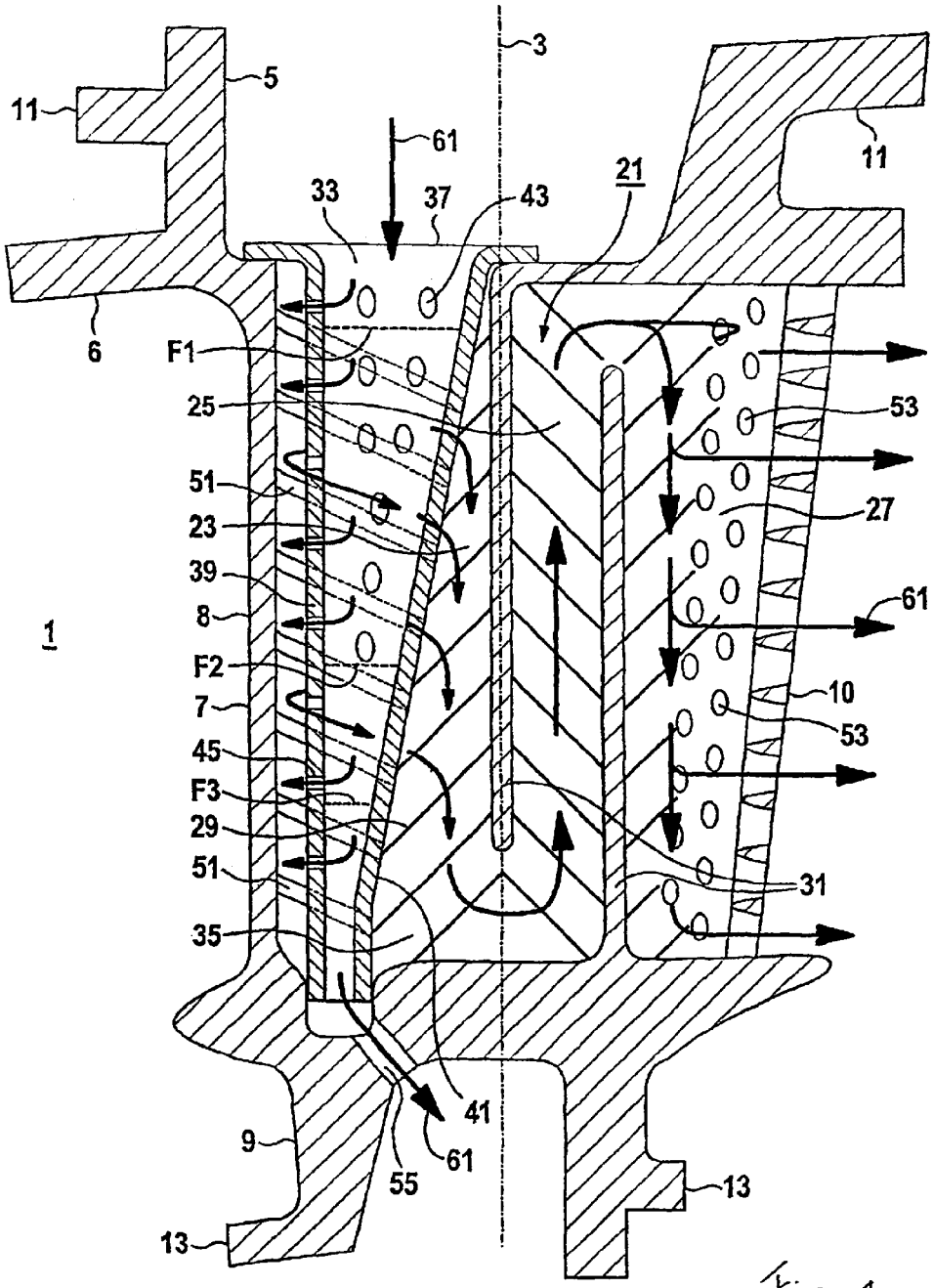

The gas turbine guide blade 1 is directed along a blade axis 3. Along the blade axis 3, the gas turbine blade 1 has, following one another, a fastening region 5, a platform region 6, an airfoil region 7 and an inner ring 9. The airfoil region 7 has an airfoil leading edge 8 and an airfoil trailing edge 10. The fastening region 5 has a hook 11 for hooking the gas turbine blade 1 in a casing (not shown) of a gas turbine. The inner ring 9 has steps 13 for engaging in a sealing system for sealing off a hot-gas duct (not shown) of a gas turbine relative to a rotor (likewise not shown) of the gas turbine. The gas turbine blade 1 is of hollow design. An internal cooling system of the gas turbine blade 1 is explained in more detail below:

A meandering cooling passage 21 leads through the interior of the gas turbine blade 1. The meandering cooling passage 21 is composed of sections 23, 25, 27 directed along the blade axis 3. These sections 23, 25, 27 are separated from one another by ribs 31. The first section 23 runs along the airfoil leading edge 8. Arranged in the meandering cooling passage 21 on the inside of the airfoil region 7 are turbulators 29 which provide for the generation of turbulence in a cooling fluid flowing through the meandering cooling passage 21, a factor which in turn results in improved heat transfer to the cooling fluid. The first section 23 is open toward the fastening region 5 and has an inlet region 33 there for cooling fluid. That end of the first section 23 which adjoins the inner ring 9 forms an outlet region 35 for cooling fluid from the first section 23, the cooling fluid subsequently entering the second section 25.

An impingement-cooling insert 37 is arranged in the first section 23. This impingement-cooling insert 37 runs in a conically tapering manner from the inlet region 33 to the outlet region 35, so that three cross-sectional areas F1, F2, F3 three following one another along the blade axis become smaller in relation to one another in this direction. In this case, the impingement-cooling insert 37 is oriented in such a way that, with its insert front side, it runs parallel to the airfoil leading edge 8. In the process, it extends over the entire length of the airfoil leading edge 8. Due to the tapering of the impingement-cooling insert 37, the first section 23 is increasingly opened up in a direction from the inlet region to the outlet region. Due to the fact that the insert rear side 41, opposite the insert front side 39, of the impingement-cooling insert 37 has a linearly sloping profile, the first section 23 is therefore divided as it were obliquely into a half covered by the impingement-cooling insert 37 and a half free of the impingement-cooling insert 37.

The impingement-cooling insert 37 has uniformly distributed impingement-cooling holes 43. Air-guide ribs 51 surrounding the impingement-cooling insert 37 are arranged on the inside of the airfoil region 7. These air-guide ribs 51 extend transversely to the blade axis 3. At the same time, they are inclined relative to a plane oriented perpendicularly to the blade axis 3. The air-guide ribs 51 each terminate before they enter the free part of the first section 23.

In the region of the airfoil trailing edge 10, film-cooling openings 53 are provided in the airfoil region 7.

The impingement-cooling insert 37 opens out in the region of the inner ring 9 at an inner-ring cooling passage 55.

When in use, the gas-turbine guide blade 1 is arranged in a gas turbine (not shown) and hot gas flows around it. The high thermal loading requires cooling by use of a cooling fluid 61, which is fed to the gas-turbine guide blade 1 via the inlet region 33 of the first section 23. Since the impingement-cooling insert 37 completely covers the inlet region 33, the cooling fluid 61 is first of all directed entirely into the impingement-cooling insert 37. From the impingement-cooling insert 37, the cooling fluid 61 discharges via the impingement-cooling holes 43 perpendicularly to the wall of the airfoil region 7 and strikes the latter in a cooling manner. In particular, the airfoil leading edge 8 is thereby cooled very effectively through leading-edge impingement-cooling holes 45.

The cooling fluid 61 which has discharged from the impingement-cooling insert 37, after impingement cooling has been effected, is then directed via the air-guide ribs 51 in the direction of the free part of the first section 23, the free part being produced by the tapering of the impingement-cooling insert 37. In this case, the cross-sectional area of the impingement-cooling insert 37 tapers in proportion to the cooling-fluid quantity discharging from the impingement-cooling insert 37. Here, the cooling fluid 61 is cooling air. The impingement-cooling air remaining at the end of the impingement-cooling insert 37 in the region of the inner ring 9 is directed via the inner-ring cooling passage 55 into the region of the inner ring 9 and serves to cool the inner ring 9. The cooling air 61 directed into the free part of the first section 23 via the air-guide ribs 51 is directed into the second section 25 and then into the third section 27. From there, it discharges from the film-cooling holes 53 into the hot-gas duct.

The airfoil leading edge 8 is impingement-cooled in an especially effective manner, although the cooling fluid 61 continues to be directed through the meandering cooling passage 21 and is thus utilized as efficiently as possible in its cooling effect. Furthermore, despite the cooling by means of the meandering cooling passage 21 via the impingement-cooling insert 37, unheated cooling air 61 can be fed to the inner ring 9, as a result of which the cooling-air consumption for cooling the inner ring 9 is kept low.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A gas turbine blade, comprising:

an airfoil leading edge;

an airfoil trailing edge; and an inner cooling structure including a meandering cooling passage with sections directed along a blade axis of the gas turbine blade, for directing a cooling fluid from the airfoil leading edge to the airfoil trailing edge, wherein a first section of the sections runs along the airfoil leading edge and includes an inlet region for the cooling fluid and an outlet region for the cooling fluid, the first section further including an impingement-cooling insert, which, with its insert front side which is directed toward the airfoil leading edge, runs parallel to the airfoil leading edge, the impingement-cooling insert tapering toward the outlet region, such that, in the first section, the type of cooling of the flowing cooling fluid in the first section changes from impingement cooling to convective cooling;

wherein the gas turbine blade is designed as a guide blade including an inner ring, the inner ring, when the guide blade is fitted into a gas turbine, sealing off a hot-gas duct of the gas turbine relative to a rotor of the gas turbine, and including an inner-ring cooling passage leading from the impingement-cooling insert to the inner ring.

2. The gas turbine blade as claimed in claim 1, wherein the impingement-cooling insert covers the entire inlet region.

3. The gas turbine blade as claimed in claim 1, wherein the impingement-cooling insert, in a cross-sectional area, tapers in proportion to a cooling-fluid quantity discharging from the impingement-cooling insert in a measured manner along the blade axis.

4. The gas turbine blade as claimed in claim 1, wherein the impingement-cooling insert is surrounded by air-guide ribs, directed transversely to the blade axis, adapted to direct cooling fluid, discharging from the impingement-cooling insert, around the impingement-cooling insert in the direction of the airfoil trailing edge.

5. The gas turbine blade as claimed in claim 4, wherein the air-guide ribs are directed relative to a plane oriented perpendicularly to the blade axis in such a way that they additionally direct the cooling fluid in a direction from the inlet region to the outlet region.

6. A guide blade, comprising:

an airfoil leading edge;

an airfoil trailing edge;

an inner cooling structure including a meandering cooling passage with sections directed along a blade axis of the guide blade, for directing a cooling fluid from the airfoil leading edge to the airfoil trailing edge, wherein a first section of the sections runs along the airfoil leading edge and includes an inlet region for the cooling fluid and an outlet region for the cooling fluid, the first section further including an impingement-cooling insert, which, with its insert front side which is directed toward the airfoil leading edge, runs parallel to the airfoil leading edge, the impingement-cooling insert tapering toward the outlet region, such that, in the first section, the type of cooling of the flowing cooling fluid in the first section changes from impingement cooling to convective cooling;

an inner ring, the inner ring adapted to, when the guide blade is fitted into a gas turbine, seal off a hot-gas duct of the gas turbine relative to a rotor of the gas turbine; and an inner-ring cooling passage leading from the impingement-cooling insert to the inner ring.

7. The guide blade as claimed in claim 6, wherein the impingement-cooling insert covers the entire inlet region.

8. The guide blade as claimed in claim 6, wherein the impingement-cooling insert, in a cross-sectional area, tapers in proportion to a cooling-fluid quantity discharging from the impingement-cooling insert in a measured manner along the blade axis.

9. The guide blade as claimed in claim 6, wherein the impingement-cooling insert is surrounded by air-guide ribs, directed transversely to the blade axis, adapted to direct cooling fluid, discharging from the impingement-cooling insert, around the impingement-cooling insert in the direction of the airfoil trailing edge.

10. The guide blade as claimed in claim 9, wherein the air-guide ribs are directed relative to a plane oriented perpendicularly to the blade axis in such a way that they additionally direct the cooling fluid in a direction from the inlet region to the outlet region.

11. A gas turbine blade, comprising:

a cooling channel including a plurality of sections for directing a cooling fluid from an airfoil leading edge to an airfoil trailing edge of the gas turbine blade, wherein a first section includes an inlet region for the cooling fluid and an outlet region for the cooling fluid, and an impingement-cooling insert, which, with its insert front side which is directed toward the airfoil leading edge, runs parallel to the airfoil leading edge, the impingement-cooling insert tapering toward the outlet region, such that, in the first section, the type of cooling of the flowing cooling fluid in the first section changes from impingement cooling to convective cooling;

wherein the gas turbine blade is designed as a guide blade including an inner ring, the inner ring, when the guide blade is fitted into a gas turbine, sealing off a hot-gas duct of the gas turbine relative to a rotor of the gas turbine, and including an inner-ring cooling passage leading from the impingement-cooling insert to the inner ring.

12. The gas turbine blade as claimed in claim 11, wherein the impingement-cooling insert covers the entire inlet region.

13. The gas turbine blade as claimed in claim 11, wherein the impingement-cooling insert, in a cross-sectional area, tapers in proportion to a cooling-fluid quantity discharging from the impingement-cooling insert in a measured manner along the blade axis.

14. The gas turbine blade as claimed in claim 11, wherein the impingement-cooling insert is surrounded by air-guide ribs, directed transversely to the blade axis, adapted to direct cooling fluid, discharging from the impingement-cooling insert, around the impingement-cooling insert in the direction of the airfoil trailing edge.

15. The gas turbine blade as claimed in claim 14, wherein the air-guide ribs are directed relative to a plane oriented perpendicularly to the blade axis in such a way that they additionally direct the cooling fluid in a direction from the inlet region to the outlet region.

16. A gas turbine blade, comprising:

an airfoil leading edge;

an airfoil trailing edge; and an inner cooling structure including a plurality of sections for directing a cooling fluid from an airfoil leading edge to an airfoil trailing edge of the gas turbine blade, wherein a first section includes an inlet region for the cooling fluid and an outlet region for the cooling fluid, and an impingement-cooling insert, which, with its insert front side which is directed toward the airfoil leading edge, runs parallel to the airfoil leading edge, the impingement-cooling insert tapering toward the outlet region, such that, in the first section, the type of cooling of the flowing cooling fluid in the first section changes from impingement cooling to convective cooling;

wherein the gas turbine blade is designed as a guide blade including an inner ring, the inner ring, when the guide blade is fitted into a gas turbine, sealing off a hot-gas duct of the gas turbine relative to a rotor of the gas turbine, and including an inner-ring cooling passage leading from the impingement-cooling insert to the inner ring.

17. The gas turbine blade as claimed in claim 16, wherein the impingement-cooling insert covers the entire inlet region.

18. The gas turbine blade as claimed in claim 16, wherein the impingement-cooling insert, in a cross-sectional area, tapers in proportion to a cooling-fluid quantity discharging from the impingement-cooling insert in a measured manner along the blade axis.

19. The gas turbine blade as claimed in claim 16, wherein the impingement-cooling insert is surrounded by air-guide ribs, directed transversely to the blade axis, adapted to direct cooling fluid, discharging from the impingement-cooling insert, around the impingement-cooling insert in the direction of the airfoil trailing edge.

20. The gas turbine blade as claimed in claim 19, wherein the air-guide ribs are directed relative to a plane oriented perpendicularly to the blade axis in such a way that they additionally direct the cooling fluid in a direction from the inlet region to the outlet region.

* * * * *